United States Patent [19]

Prevot

[11] Patent Number: 4,946,098

[45] Date of Patent: Aug. 7, 1990

[54] CENTRAL HEATING INSTALLATION WITH A HOT WATER CIRCUIT FOR DOMESTIC USAGE

[75] Inventor: René Prevot, Drancy, France

[73] Assignee: E. L. M. Leblanc, Drancy, France

[21] Appl. No.: 308,088

[22] Filed: Feb. 9, 1989

[30] Foreign Application Priority Data

Feb. 16, 1988 [FR] France ..... 88 01800

[51] Int. Cl.[5] ..... F24D 3/08

[52] U.S. Cl. ..... 237/19; 165/143

[58] Field of Search ..... 237/19; 165/162, 143, 165/141; 122/13 R, 20 B

[56] References Cited

U.S. PATENT DOCUMENTS 2,452,391 10/1948 O'Sullivan et al. ..... 165/143 X

*Primary Examiner*—Henry A. Bennet
*Assistant Examiner*—John Sollecito
*Attorney, Agent, or Firm*—Pollock, Vande Sande & Priddy

[57] ABSTRACT

A central heating installation provided with a hot tap water circuit for domestic usage includes a heating apparatus having an enclosure the inner portion of which is provided with a burner, notably a gas burner, and on which is possibly wound or a heating circuit duct extending thereafter through a fin assembly situated in the upper portion of the enclosure, along the path of travel of the hot gases, the heating circuit, when extending through the fin assembly, being provided in the shape of a plurality of flattened tubes connected to one another by elbows and the hot tap water circuit being provided in the form of a tube having the shape of a hairpin or of a pipe coil and placed inside the flattened tubes where they extend through the fin assembly. The sanitary hot tap water circuit tubes, placed in the shape of hairpins or coil tubes inside the heating water circuit flattened tubes, are not in contact with the latter, and the dimensions of the flattened tubes and of hairpin tubes are chosen in such manner that the volume of water contained between the flattened tubes and the turns of the hairpin-shaped tubes is reduced to a minimum.

7 Claims, 4 Drawing Sheets

12
12'
10'
20
14
16

30
32
28
30
32

12'
28
10'

22
20
24

20
22
24

18
26

CENTRAL HEATING INSTALLATION WITH A HOT WATER CIRCUIT FOR DOMESTIC USAGE

FIELD OF THE INVENTION

The present invention relates to a central heating installation provided with a hot tap water circuit for domestic usage, and including a heating apparatus comprising an enclosure or the lower portion of which is provided with a burner, notably a gas burner, and on which there may be wound a duct inside of which flows the heating circuit water, this circuit extending through a fin assembly situated in the upper portion of the enclosure along the path of the hot gases escaping from the burner so as to be guided thereafter toward a discharge duct.

BACKGROUND OF THE INVENTION

Central heating installations of this type are known, in which the hot tap water circuit includes a second duct inside of which flows the heating water, and which extends through the fin assembly in intimate heat contact with the first duct inside of which flows the heating water.

French patent No. 1 352 607 discloses such a heating installation in which the intimate thermal connection between the first duct inside of which flows the heating circuit water and the second duct inside of which flows the tap circuit water is obtained by joining the two ducts in such a manner that they form a double passage tube extending through the fin assembly, this tube having a cross section of appropriate shape, for example circular or elliptic.

By BE-A-671 097 are also known double duct heating installations in which the intimate thermal contact between the ducts, respectively for the heating water circuit and for the tap water circuit, is obtained by incorporating one of the ducts inside the other, these two ducts being then provided in the form of two tubes, possibly concentrical, extending through the fin assembly of the heating apparatus, the outer surface of the inner tube being jointly applied against the inner surface of the outer tube.

Experience shows that in the heating apparatus of the hereabove mentioned type, it is not possible to obtain a perfect thermal exchange between the two ducts since the contact surface between the water conveyed by the heating duct and the tap water duct placed inside the heating duct is too limited. The result is that when there is a non-circulation of water in one of the ducts for an extended period, its temperature can exceed that of the water in movement, and the totality of the heat energy collected by the water which is not circulating is then not transmitted to the water in circulation. The result is that with these known installations it is necessary to have the heating water circulated by starting a heating circuit accelerator in order to obtain an immediate heating of the tap water, thereby compelling the provision of a separate circuit for this circulation when the central heating installation is not in service (as for example during summer).

In order to mitigate these difficulties, it has been envisaged—FR-A-1 484 821— to form a heat exchanger in which the heating circuit, when extending through a fin assembly, is provided in the form of a plurality of flattened tubes connected to one another by shoulders, and the tap water circuit is provided in the form of a tube bent in the shape of an S or a hairpin, and placed inside the flattened tubes forming the heating circuit duct.

In such a known installation, the rectilinear walls of the tap water circuit tube are plated and generally soldered against the corresponding walls of the heating water circuit flattened tube in which is positioned the tap water circuit. This arrangement has a serious disadvantage: in fact, the physical contact between the two tubes can lead to the boiling of the tap water since, in that case, there is a direct thermal contact between the hot gas flowing through the fin assembly and the two tubes forming the tap water and heating water circuits.

OBJECTS AND SUMMARY OF THE INVENTION

The object of the present invention is to provide an improved installation which does not present the hereabove mentioned disadvantages.

Therefore, its object is a central heating installation provided with a hot water circuit to heat water (i.e. tap water) for domestic usage which includes a heating apparatus comprising an enclosure the inner portion of which is provided with a burner, notably a gas burner, and on which is possibly provided a heating circuit duct, extending thereafter through a fin assembly situated in the upper portion of the enclosure in the path of travel of the hot gases, the heating circuit, when extending through the fin assembly, being provided in the shape of a plurality of flattened tubes connected to one another by elbows and the hot tap water circuit being provided in the form of a tube having the shape of a hairpin or of a pipe coil and placed inside said flattened tubes where they extend through the fin assembly, characterized in that:

the hot tap water circuit tubes, placed in the shape of hairpins or coil tubes inside the heating water circuit flattened tubes, are not in contact with the latter, and the dimensions of said flattened tubes and of said hot tap water circuit tubes are chosen in such manner that the volume of water contained between the flattened tubes and the turns of the hairpin-shaped tubes are as reduced as possible.

According to a feature of this invention, there is provided at each end of the flattened tubes, outside the fin assembly, an end-piece which is brazed or soldered on said end so as to close it, this end-piece having the shape of a plate formed with a first opening for the connection of the bent tube, providing for the connection between the coil pipes or hairpins of the tap water duct, and with a second opening for the connection of the bent tube which provides for the connection between two consecutive flattened tubes.

According to another feature of this invention and for still increasing the thermal exchanges between the heating water circuit and that of the tap water, where they extend through the fin assembly, there is provided a thermal transmission surface between the turns of the tube wound in the shape of a hairpin or of a coil pipe inside the flattened tubes.

According to the invention, said thermal transmission surface is provided in the shape of a metallic plate including partially cylindrical portions mating with the shape of the hairpin-shaped tube, on which they come in engagement, connected by vertical plane portions.

Other features and advantages of the invention will become more apparent from the hereafter detailed description, with reference to the accompanying drawings illustrating embodiments thereof which have no limiting character.

DETAILED DESCRIPTION OF THE INVENTION

Figures 1, 3, 4, 5, 6, 7:
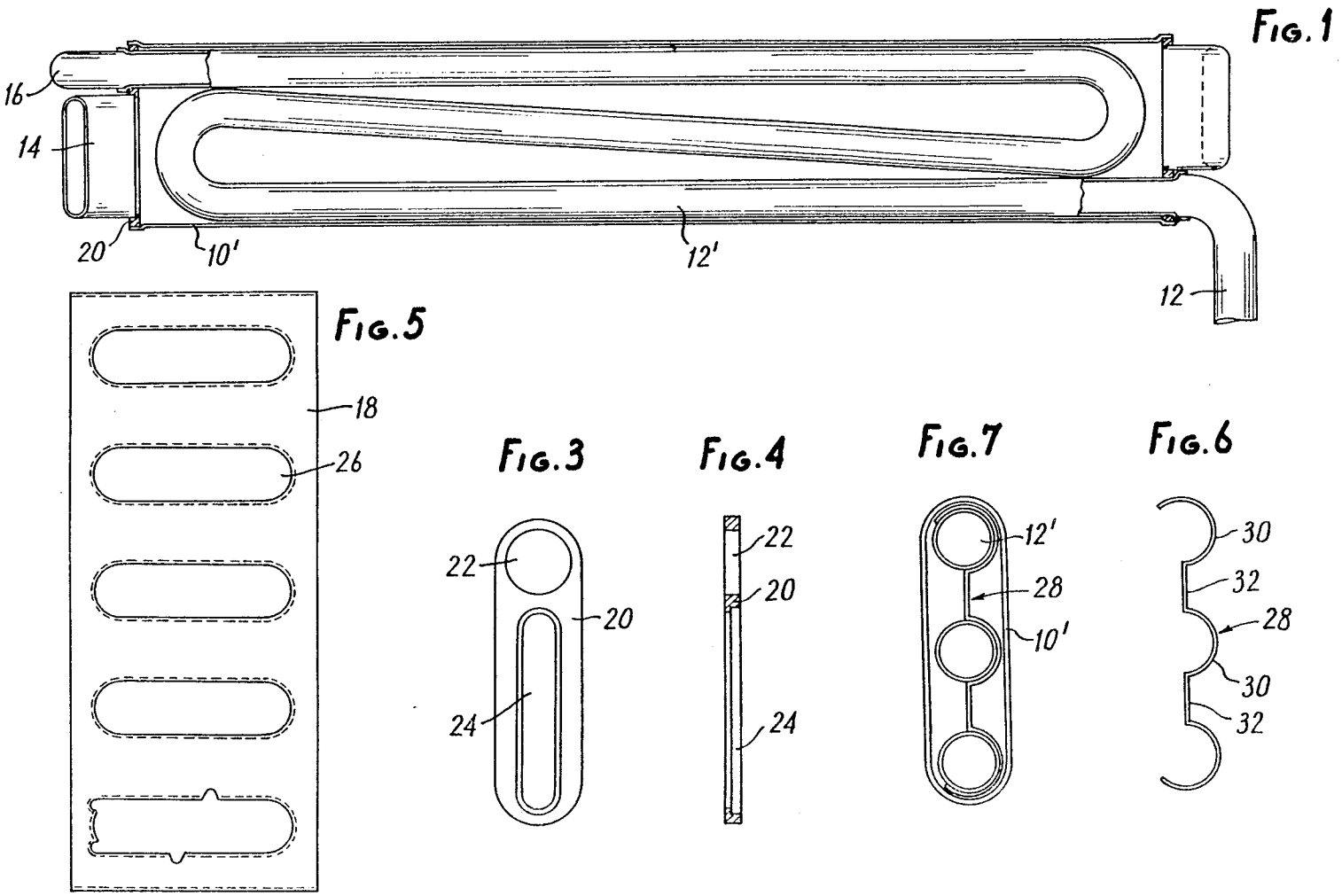
FIG. 1 is a partial side elevation and partial vertical sectional view showing the relative disposition of the heating water duct and of the tap water duct, in the position where they extend through the fin assembly placed at the upper portion of the heating apparatus shell ring.
FIGS. 3 and 4 are respectively side elevation and front views of an end-piece provided according to the invention for closing each end of the installation ducts, where they come out from the fin assembly.
FIG. 5 is a plan view of a fin which is part of the fin assembly of the heating apparatus.
FIG. 6 is a vertical sectional view of an embodiment of a surface providing for the improved heat transfer between the heating water contained in the flattened tubes and the hairpin-shaped duct for the tap water
FIG. 7 is a vertical sectional view showing the disposition of the heat transfer surface shown in FIG. 6, in the heating water duct.
Figure 2:
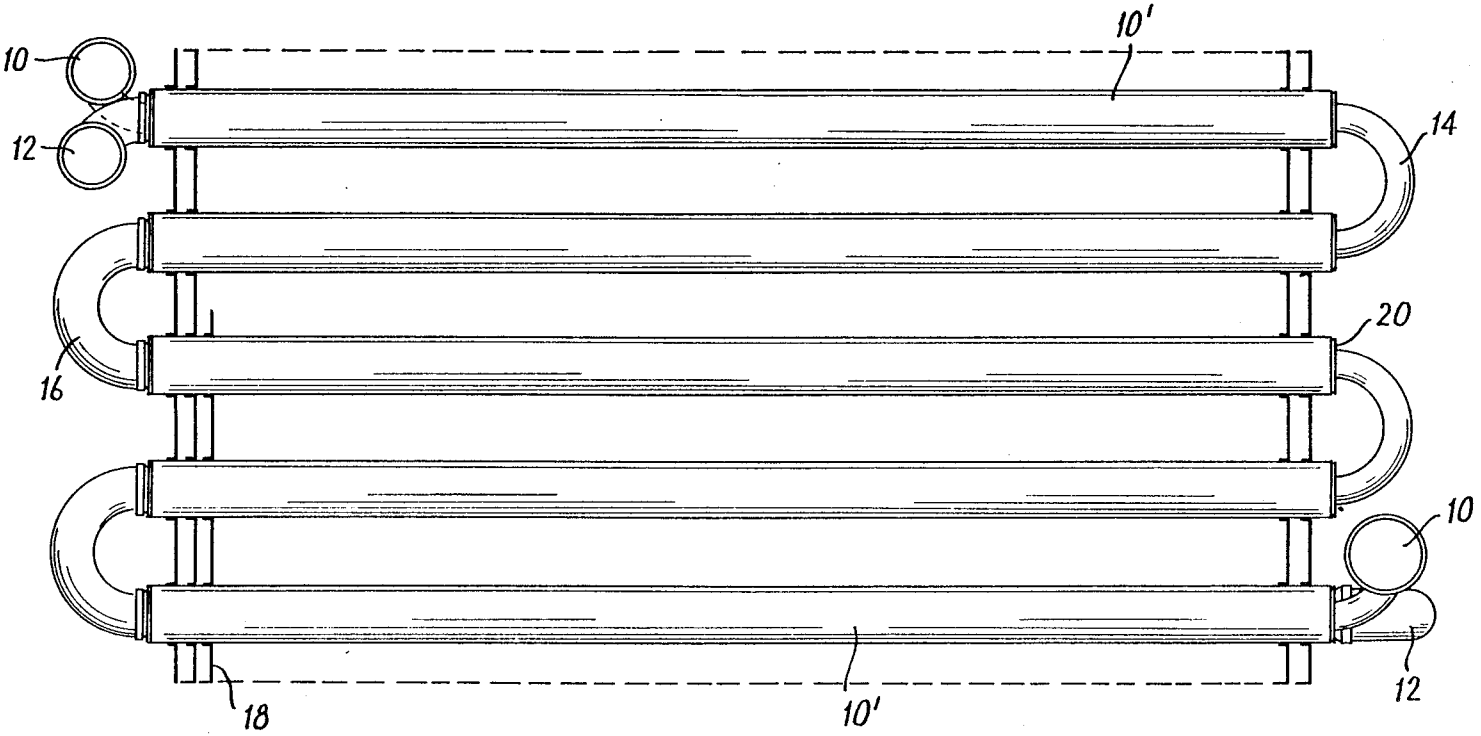
FIG. 2 is a plan view of FIG. 1.
Figure 8:
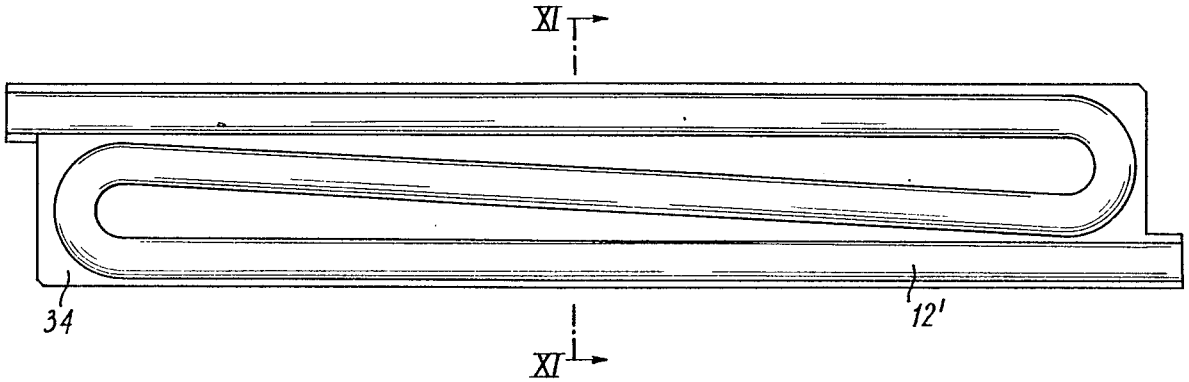
FIGS. 8 to 11 illustrate a variant of the invention, in side elevation, plan and sectional views according to XI–XI.
Figure 10:
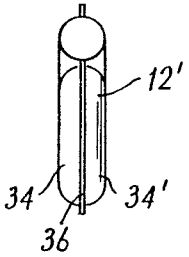
Figure 9:
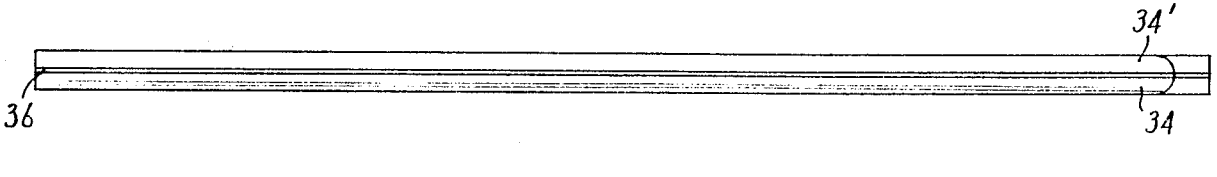
Figure 11:
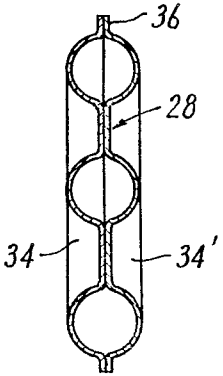

With reference to the drawings and notably to FIGS. 1 and 2, one sees that the heating apparatus which is the object of this invention includes a first duct 10 for heating the water of the central heating circuit and a second duct 12 for heating the tap water for domestic usage. In order to improve the thermal heat transfer, the two ducts have an intimate thermal exchange in the upper portion of the heating apparatus where the fin assembly 18 is positioned (portion shown in FIGS. 1 and 2).

According to the invention, in this upper portion of the heating apparatus, duct 10′ of the circuit in which flows the heating water is in the shape of a plurality of flattened tubes such as 10′, having each a cross section of oval shape, or substantially oval, the great axis of which is placed vertically. As will be disclosed in detail hereafter, the various flattened tubes 10′ placed parallel are connected at their ends by bent tubes or arcuate connectors such as 14.

The tap water duct 12 is made of a tube preferably of circular cross section, and is placed inside the flattened tubes such as 10′ through which it extends while having the configuration of a hairpin or of a coil pipe so as to considerably increase the heat exchange surface between the heating water flowing through the flattened tubes 10′ and the sanitary water contained in the hairpin-shaped tube 12′, when extending through the flattened tube. As may be seen clearly in FIG. 1, each tube 10′ forming a portion of the heating water circuit when extending through the fin assembly 18 receives a hairpin-shaped portion 12′ of the tap water duct. The positioning of the hairpin-shaped tube section 12′ in the flattened tube 10′ forming the heating water duct is provided in such manner that there is no contact between the walls of tubes 12′ and 10′. Moreover, the hairpin-shaped tube section 12′ is chosen in such manner that the volume of water contained between the flattened tube 10′ and the hairpin or coil pipe 12′ is reduced as much as possible so that the water flowing in the sanitary circuit 12 collects all the heat energy from the heating water, without it being necessary to put into service a heating circuit accelerator, a conventional device used to circulate the hot water. The absence of contact between the walls of tubes 10′ and 12′ prevents the tap water flowing in tube 12′ from boiling.

The closing of the ends of the flattened tubes 10′ is provided according to the invention by end-pieces 20 in the shape of plates (FIGS. 3 and 4) which are formed with an opening 22 for the connection of the bent tubes 16 providing for the connection between two consecutive coil pipes or hairpin-shaped tubes 12′ and a second opening 24 for the connection of bent tubes 14 ensuring the connection between two consecutive flattened tubes 10′. The end-piece plates 20 are preferably brazed on the ends of tubes 10′.

FIG. 5 shows an embodiment of a fin 18. It includes a series of openings such as 26 the shape of which corresponds to the cross section of the flattened tubes 10′, said fins being successively mated onto the parallel tubes 10′ and brazed in a known manner (see FIG. 2).

In order to still improve the heat exchanges between the two fluids (heating water - tap water), when they flow through the fin assembly 18, one can provide extra exchange surfaces 28 connecting the sections of the hairpin-shaped tube or coil pipe 12′ incorporated in each flattened tube 10′.

In the example shown in FIGS. 6 and 7, this extra exchange surface has the shape of a plate including a partially cylindrical portion 30 which engages on various portions of tube 12′ wound in the shape of a hairpin, these portions 30 being connected by vertical plane portions 32. FIG. 7 shows the relative disposition of tube 12′ wound in the shape of a hairpin, provided with plate 28 and the flattened tube 10′ inside of which is disposed the hairpin 12′. Plate 28 may be possibly brazed on tube 12′.

One sees that due to the invention, there is obtained a maximum exchange surface between the two ducts 10′ and 12′, and consequently a maximal thermal exchange between the heating water and the tap water circuits.

In the variant shown in FIGS. 8 to 11, tube 12′ arranged as a hairpin or a coil pipe is made as an integral structure with plate 28, the tube and plate assembly being stamped in the shape of two half shells 34, 34′ which are connected by their junction plane 36, and made fast by a soldering process without filler metal, for example by pressure, ultrasounds or others.

Figure 12:
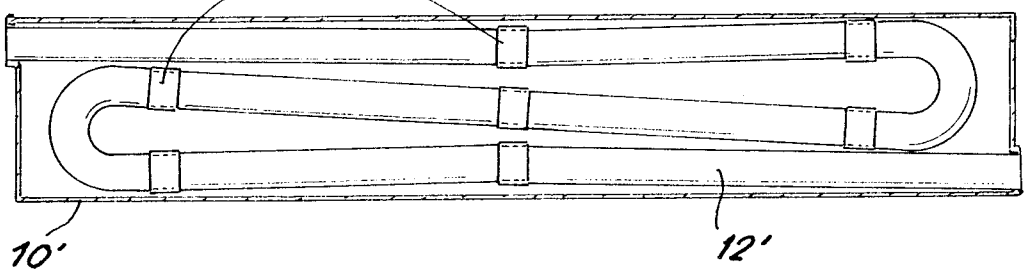
FIG. 12 is a schematic view similar to FIG. 1, showing another variant of the present invention.

In the alternative embodiment of the invention shown in FIG. 12, tube 12′, arranged as a hairpin or as a coil pipe, in which flows the tap water, has a configuration slightly bent in its portions which are situated in the vicinity of the walls of tube 10′ in which flows the heating water, and this tube 12′ is provided with a plurality of rings (annular couplings) 38 made of a heat and moisture resisting plastic material, for example silicone, said annular couplings being threaded onto tube 12′ at regular intervals as shown in FIG. 12. This particular disposition has a double advantage: first of all, any contact of tube 12′ with the tube which forms duct 10′ in which flows the heating water is avoided; and, secondly, vibrations of hydraulic origin such as resonance which occur in this type of installation when the tap water flows in the coil pipe forming the tap water duct are eliminated.

When reading the hereabove description, one sees that the invention provides a heating installation ensuring the best possible heat exchange between the heating water and tap water incorporated circuits, thanks to a large thermal contact surface without physical contact of the circuits, by the relative position of the two ducts, by the hairpin shape of the tube of the tap water circulation duct extending through the flattened tube of the heating water duct, by the small volume of water contained between each flattened tube and the tube formed as a hairpin and contained therein and preferably due to the arrangement of plastic material couplings threaded onto the tube forming the tap water circuit, maintaining the latter spaced apart from the tube forming the heating water circuit by eliminating any source of vibrations of hydraulic origin.

Due to these novel characteristics, when there is a prolonged non-circulation of the water in one of the ducts (for example in the heating water duct during the summer period), its temperature cannot exceed that of the water in movement since a maximum quantity of the heat energy collected by the water which is not in circulation is transfered to the water in circulation.

On the other hand, it is always possible to obtain the maximum power developed by the heating apparatus in one of the ducts when the water circulation is stopped in the other duct. Finally, the invention allows, by water circulation in both circuits, a distribution of the maximum power of the apparatus between the two circuits as a function of the desired hot water flow rates, while preventing the hot tap water from boiling. Moreover, the invention allows a large saving of materials (brazing material) as compared to the known solutions involving jointed tubes.

Of course, the present invention is not limited to the embodiments described and shown hereabove and it encompasses all the variants thereof.

I claim:

1. A central heating installation comprising:

an enclosure having a burner provided within an inner portion thereof and a heating circuit duct extending through a fin assembly situated in an upper portion of the enclosure and in a path of travel of hot gases produced by the burner;

a water heating circuit extending through the fin assembly, and comprising a plurality of flattened tubes connected to one another by arcuate connectors;

a tap water heating circuit including a plurality of tubular sections each having a coil or hairpin shape positioned inside a corresponding one of the flattened tubes extending through the fin assembly;

wherein each section of the tap water heating circuit is positioned inside, but not in contact with, its corresponding flattened tube of the water heating circuit; each section having an outer peripheral dimension which defines the volume of the section; and wherein the dimensions of the flattened tubes of the water heating circuit closely conform to lateral portions of the outer peripheral dimensions of the sections of the tap water heating circuit thereby defining a minimum volume of water contained within the flattened tubes.

2. A heating installation according to claim 1, wherein there is provided at an end of each flattened tube, outside the fin assembly, an end-piece fixedly mated to the tube to effect a closing therefor, this end-piece having a first opening for providing a connection between adjacent ducts of the coil or hairpin-shaped sections of the tap water heating circuit, and a second opening for effecting a coupling with a corresponding arcuate connector to provide connection between two adjacent flattened tubes.

3. A heating installation according to claim 1, wherein to further increase thermal exchanges between the water heating circuit and the tap water heating circuit extending through the fin assembly, there is provided between each turn of the coil or hairpin-shaped tubular section inside each of the flattened tubes, a thermal transmission surface means.

4. A heating installation according to claim 3, wherein the thermal transmission surface means comprises a metallic plate including partially cylindrical portions intimately mating between said each turn of the coil or hairpin-shaped section, the cylindrical portions being connected by vertical plane portions.

5. A heating installation according to claims 4, wherein the metallic plate is brazed onto the coil or hairpin-shaped section.

6. A heating installation according to claim 4 characterized in that the tube arranged as a hairpin or a coil pipe is made as an integral structure with said plate, the tube and plate being stamped in the shape of two half shells connected by their junction plane and made fast with one another by a soldering process without filler metal, notably by pressure, ultrasounds or others.

7. A heating installation according to claim 1 characterized in that the tube arranged as a hairpin or a coil pipe and in which flows the tap water, has a configuration which is slightly bent in its portions which are situated in the vicinity of the walls of the tube in which flows the heating water, and this tube is provided with a plurality of rings made of a heat and moisture resisting plastics material, such as for example silicone, said rings being threaded onto said tube at regular intervals.

* * * * *